US005339901A

United States Patent [19]

McKinzie

[11] Patent Number: 5,339,901

[45] Date of Patent: Aug. 23, 1994

[54] METHOD OF ACHIEVE ZONAL ISOLATION

[75] Inventor: Howard L. McKinzie, Sugar Land, Tex.

[73] Assignee: Texaco Inc., White Plains, N.Y.

[21] Appl. No.: 52,597

[22] Filed: Apr. 26, 1993

[51] Int. Cl.[5] ..... E21B 43/114

[52] U.S. Cl. ..... 166/289; 166/191

[58] Field of Search ..... 166/289, 51, 191, 147, 166/155

[56] References Cited

U.S. PATENT DOCUMENTS 2,894,588 7/1959 Tausch et al. ..... 166/191 X 4,401,158 8/1983 Spencer et al. ..... 166/191 X

*Primary Examiner*—Willliam P. Neuder

*Attorney, Agent, or Firm*—James L. Bailey; Kenneth R. Priem; Russell J. Egan

[57] ABSTRACT

Pairs of isolation members are mounted externally on casing pipe to define isolation zones. The zones are places into communication by bypass means external to the casing and penetrating the isolation members. Consolidation material is flowed through the bypass means to successively fill the isolated zones.

9 Claims, 1 Drawing Sheet

METHOD OF ACHIEVE ZONAL ISOLATION

BACKGROUND OF THE INVENTION

1. Field of the Invention

The present invention pertains to a method of achieving zonal isolation in open-hole type completions by using a bypass to transport a consolidation material such as cement, or any other sealing material (for example a resin used for sand control and fluid shutoff), to the localized zones to be consolidated. Preferably these zones will be near the end connections of the pipe.

2. The Prior Art

From a production point of view, the most desirable method of completing either a vertical or horizontal well, especially in very competent formations, is to have an "open hole" well, i.e., a well that does not require cementing a casing or liner extending through the production zone. In general terminology, "open hole" can mean any well completion without any tubulars, or with a slotted liner, preperforated liner etc, with or without a gravel pack. However, open hole completions are often not used because of the difficulty encountered when trying to "work over" the completion. The work over could be required because of sand production, near wellbore damage, the need to fracture or acidize the well, or any of several other operations. Most of these operations require that certain zones within the production interval be treated individually. This is not normally possible in long open hole completions because it may be necessary to isolate small sections of the production zone, to ensure that the whole interval can be effectively treated. This is especially true for horizontal wells with long sections.

Numerous techniques have been attempted to achieve zonal isolation, but at the present time they are generally prohibitively expensive and notoriously unreliable. Diverting agents and pills are often used, but they are difficult to remove and may damage the zones of highest productivity. External inflatable packers may be used, but they are very expensive. In addition, inflatable packers have a very large percentage of failures.

SUMMARY OF THE PRESENT INVENTION

The present invention is a method of achieving zonal isolation in open hole completions which is much less expensive and which will not result in extensive formation damage. Pairs of isolation members are mounted spaced apart on the liner pipe. Bypass means are fixed to the liner pipe interconnecting the volumes defined by the spaced pairs of isolation members. Consolidation material is pumped through the bypass to successively fill the isolation volumes thereby effecting zonal isolation.

BRIEF DESCRIPTION OF THE DRAWINGS

The present invention will now be described, by way of example, with reference to the accompanying drawings, in which.

DETAILED DESCRIPTION OF THE PREFERRED EMBODIMENT

Figure 2:
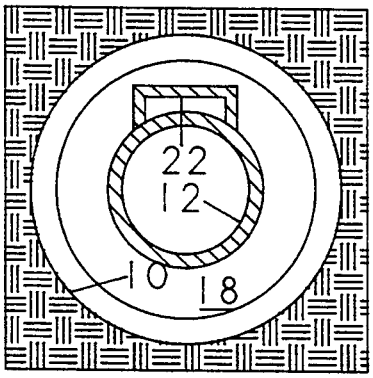
FIG. 2 is a transverse section through a first embodiment of the present invention shown in FIG. 1.
Figure 3:
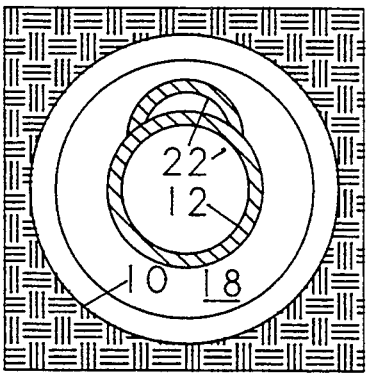
FIG. 3 is a transverse section through a second embodiment of the present invention.
Figure 1:
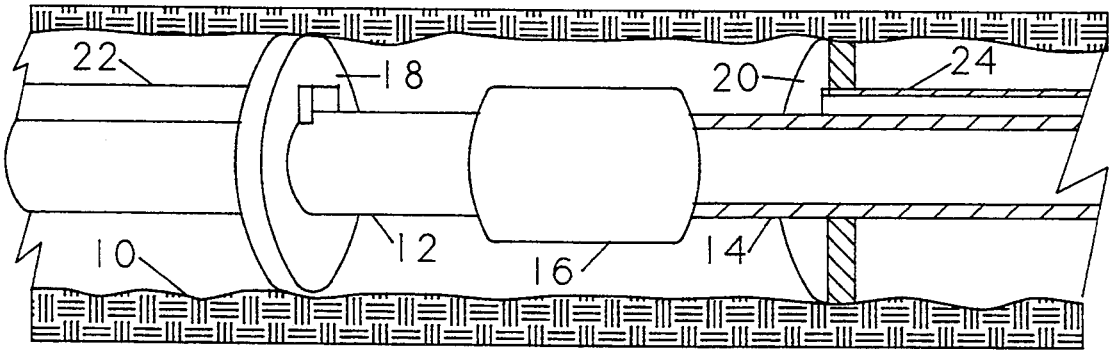
FIG. 1 is a longitudinal diagrammatic view, partially in section, of an embodiment of the present invention.

Turning now to FIG. 1, a well 10 (here shown horizontal for convenience only) has therein a liner string represented by pipes 12, 14 coupled by standard joint 16. A pair of opposed, spaced isolation members 18, 20 are mounted on the respective pipes 12, 14 flanking the joint 16. The isolation members 18, 20 can be selected from any of a number of available means to provide a temporary wiping seal between the liner and the borehole wall. For example a pair of opposed cup washers (as shown) could be used with or without backing or stiffening means (not shown) as well as known inflatable packers. The only requirement for these members is that they be capable of making a temporary annular seal between the borehole wall and the liner pipe. Each pipe 12, 14 is provided with bypass means 22, 24 welded longitudinally thereon with the ends of the bypass means passing through respective isolation means. The bypass means can have anyone of a number of profiles, such as those suggested by FIGS. 2 and 3.

The present invention involves achieving isolation of selected zones by conveying consolidation material liner of any type to each zone. This is accomplished by mounting on the liner pairs of opposing spaced isolation members 18, 20, each capable of forming an expandable annular seal to restrict fluid flow, flanking the zone to be isolated. Preferably, and for convenience in mounting, these isolation members are placed near the ends of the liner pipe sections. A fluid-conducting bypass 22, 24, such as a u-tube or semicircle pipe, is welded to the liner pipe 12, 14, extending a sufficient length of the respective liner pipe so that the ends of the bypass extending through the isolation members 18, 20 mounted on the liner. An assembly of liner pipes, bypasses and isolation members are connected together to the length and pattern of the production zone to be isolated.

Zonal isolation is achieved by pumping a consolidated material, such as cement or resin, through the bypass to the bottom of the assembly sequentially filling the annular isolated volumes defined by the isolation members outside the liner. The cement or other material fills the cavity outside the pipe between the first pair of opposed, spaced isolation members and then flows through the bypass to the next set of isolation members preferably also located at a joint where the next pipe is connected. This location is preferred only because of the necessity of sliding these isolation members onto the pipes. At the connection, the annular space is again filled with cement between the opposed isolation members and then flow proceeds on into the next bypass on the next pipe. If a resin is used, some of the material will penetrate into the formation, improving the strength of the seal between the joints of pipe. The amount of leak off can be controlled by controlling the viscosity of the resin material. The resin can be made to consolidate by incorporating an internal catalyst and/or heat. Additionally, a solid material such as sand, clay, or any other filler, could be added to the resin to reduce the cost of a given volume of the mixture, and to reduce the leak off rate into the formation.

Figure 4:
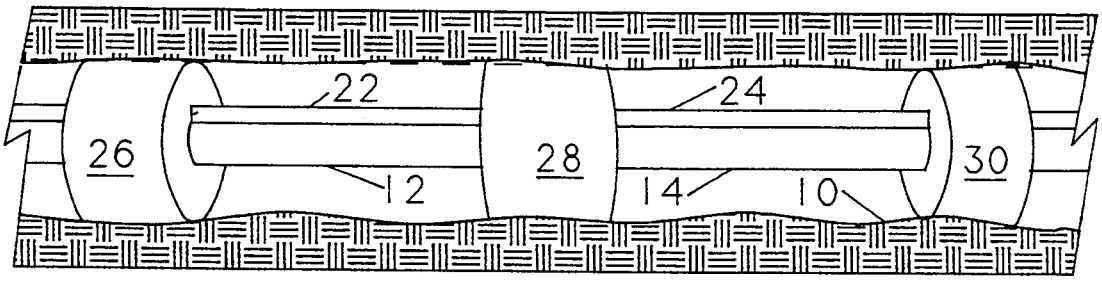
FIG. 4 is a side elevation showing three cemented zones.

In this manner, the annular space at each connection is filled with cement, providing zonal isolation at each successive set of opposed isolation members such as 26, 28, 30 shown in FIG. 4. Even if a small amount of consolidation material leaks into the isolated zones, it will not significantly impair production. In the event an entire joint is filled with consolidation material, e.g. if one of the opposed isolation members leaks, this joint could still be perforated as with a normal cemented liner. Note also that it is not necessary that the shunts be aligned.

Additionally, if a complete seal is not obtained in a cemented section, two lengths of liner can still be isolated as a single unit. Several other options could be used to seal the cement at the joint, and numerous options for the type of liner used are available.

The present invention may be subject to many modifications and changes without departing from the spirit or essential characteristics thereof. The present embodiment should therefor be considered in all respects as being illustrative and not restrictive of the scope of the invention.

I claim:

1. Means for selectively isolating ay number of zones spaced along a completed open hole type well comprising:

a well liner extending at least through the zones to be isolated;

pairs of isolation means mounted on said liner spaced apart at respective opposite ends of each zone to be isolated; and bypass means passing through said pairs of isolation means to interconnect the volumes defined thereby whereby consolidation material can be sent downhole to fill and isolate each successive zone defined by said pairs of isolation means.

2. Means according to claim 1 wherein said consolidation material is cement.

3. Means according to claim 1 wherein said consolidation material is resin material.

4. Means according to claim 1 wherein said consolidation material is a resin containing solid filler.

5. Means according to claim 1 wherein said consolidation material is any known material commonly associated with well completions.

6. Means according to claim 1 wherein said first and second isolation means are opposed cup washers.

7. Means according to claim 1 wherein said first and second isolation means are inflatable packers.

8. Means according to claim 1 wherein said first and second isolation means are an expandable or inflatable tool suitable for creating a temporary seal in situ.

9. Means according to claim 1 wherein said liner is a slotted liner, wire wrapped screen, preperforated liner, unperforated liner.

* * * * *